United States Patent [19]

Simmons et al.

[11] Patent Number: 4,616,784

[45] Date of Patent: Oct. 14, 1986

[54] SLURRY ATOMIZER

[75] Inventors: Harold C. Simmons, Richmond Hts.; Curtis F. Harding, Parma, both of Ohio

[73] Assignee: Parker Hannifin Corporation, Cleveland, Ohio

[21] Appl. No.: 673,294

[22] Filed: Nov. 20, 1984

[51] Int. Cl.[4] ..... B05B 7/10

[52] U.S. Cl. ..... 239/404; 239/406; 239/424

[58] Field of Search ..... 239/404, 405, 406, 423, 239/424

[56] References Cited

U.S. PATENT DOCUMENTS

| | | | |
|---|---|---|---|
| 1,342,732 | 6/1920 | Anthony | 239/405 |
| 1,396,086 | 11/1921 | Anthony | 239/404 |
| 1,451,063 | 4/1923 | Anthony | 239/404 |
| 1,567,482 | 12/1925 | Anthony | 239/404 |
| 3,685,741 | 8/1972 | O'Sickey | 239/406 |

FOREIGN PATENT DOCUMENTS

| | | | |
|---|---|---|---|
| 504830 | 12/1954 | Italy | 239/405 |

*Primary Examiner*—Joseph F. Peters, Jr.
*Assistant Examiner*—Michael J. Forman
*Attorney, Agent, or Firm*—Frederick L. Tolhurst

[57] ABSTRACT

An atomizing nozzle suitable for use with high-viscosity slurries wherein a body (10) and forming element (40) include passageways (18, 22 and 48) that lead to a conical chamber (65) having a discharge annulus (66). The slurry exits discharge annulus (66) in a cylindrical continuous film. The inside of the film is exposed to swirled, compressed gas from an internal bore (50) of forming element (40) and the outside of the film is exposed to swirled compressed gas in a swirl chamber (72) to atomize and mix the slurry.

11 Claims, 4 Drawing Figures

SLURRY ATOMIZER

BACKGROUND OF THE INVENTION

1. Subject of the Invention

The subject invention is generally directed to nozzles and, more particularly, nozzles suitable for atomizing high viscosity slurries.

2. Description of the Prior Art

In recent years, there has been increased interest in the use of fuel slurries; that is, a mixture of powdered solid fuel suspended in a liquid. The liquid may be combustible, such as oil; or incombustible, such as water. In addition, the slurry may contain additives that tend to maintain the solids in suspension and retard settling. In either case, it has been found preferable to maximize the relative solid content of the mixture. Thus, slurry mixtures are characterized by high viscosity.

For example, coal slurries have been formed wherein powdered coal is suspended in water. A typical coal/-water slurry contains up to about 70% by weight of coal that has been screened to a particle size of about 200 micrometers. The coal particles have varying mineral content and are generally abrasive.

At the time of combustion, the slurry fuel must be atomized such that it is dispersed and mixed with air in a manner similar to the atomization of liquid fuels. Furthermore, if the suspension liquid is noncombustible, such as water, it must be evaporated before the solid fuel particles can be burned.

For many years, various devices such as spray-drying towers have been used to spray and disperse slurries. However, these devices used a rotating-disc or wheel that was motor driven and were, therefore, unsuitable for use in combustion applications.

Many types of nozzles for atomizing low-viscosity liquid fuels are known in the prior art. For example, various nozzles have been used to atomize petroleum-based liquid fuels for combustion in a furnace or boiler. Basically, many such liquid atomizers accelerate the liquid to a high velocity and interact it with a gas such as air or steam. The resulting turbulence disrupts the liquid stream into small particles. Other liquid atomizers atomize low viscosity liquid fuels such as kerosene by pressurizing the liquid and forcing it through a small orifice or swirl chamber. However, such prior nozzles were found to be sensitive to the viscosity of the liquid fuel so that they were not well suited for use with high-viscosity slurries.

In atomizing relatively high-viscosity liquid fuels such as heavy petroleum distillates or residual oils, it has been generally necessary to use a different nozzle wherein high-pressure air or steam is used to accelerate the liquid fuel. In addition, the high-viscosity liquid fuels are also sometimes preheated.

Because of the abrasive nature of slurry particles, such high-viscosity liquid fuel atomizers are generally unsuited for use in atomizing a slurry. In many such high-viscosity nozzles, the fuel and gas interact inside the atomizer. Thus, the fuel is accelerated to high velocities inside the atomizer. Since the solid fuel particles of slurries, such as a coal/water slurry tend to be abrasive, the use of such nozzles with slurries allowed the accelerated particles to scrub the internal surfaces of the atomizer. This resulted in rapid erosion of the nozzle. Thus, there was a need in the prior art for an atomizer that was not sensitive to the viscosity of the slurry or subject to rapid erosion by the slurry particles.

SUMMARY OF THE INVENTION

In accordance with the subject invention, a slurry atomizer includes a body that has an input end and a discharge end. The body includes one or more passageways that communicate with the input end and form an opening at the discharge end. A casing covers the discharge end of the body and cooperates with the body to define an annulus. A forming element located at the discharge end of the body has an input face at one end and a generally axially extending projection at the opposite end. The forming element includes slurry passageways that communicate with the body passageways. The forming element also includes an internal bore and at least one lateral passageway that opens to the internal bore and is in communication with the annulus. A conical section is located adjacent the projection of the forming member. The conical section includes an orifice and cooperates with the projection to define a conically shaped chamber with the slurry passageways opening thereto. A swirler is located between the discharge end of the casing and the conical member. The swirler provides a discharge orifice for the atomizer and cooperates with the conical member to define a swirl chamber. The swirler also has a flow path that opens to the swirl chamber and is in communication with the annulus.

Preferably, the projection of the forming member terminates in a tubular member. The tubular member cooperates with the conical member to define an annulus and has a discharge end that is located in substantially the same place as the outer surface of the conical member at its orifice.

Also preferably, the forming element includes a discharge face that is oppositely disposed from the input face and at least one passageway between the input face and the discharge face. The projection of the forming element extends from the discharge face.

Most preferably, the lateral passageways of the forming element are tangentially aligned at a first direction with respect to the internal bore to provide swirled fluid to the internal bore. The fluid flow path of the swirler is a plurality of bores that are also tangentially aligned with respect to the internal bore to provide swirled fluid to the swirl chamber. The bores of the swirler are aligned in a different direction than the lateral passageways of the forming element so that the fluid in the swirl chamber is swirled in an opposite sense from the fluid in the internal bore.

Other details, objects and advantages of the subject invention will become apparent from the following description of a presently preferred embodiment thereof.

BRIEF DESCRIPTION OF THE DRAWING

The accompanying drawings show a presently preferred embodiment of the subject invention wherein.

DESCRIPTION OF THE PREFERRED EMBODIMENT

Figure 1:
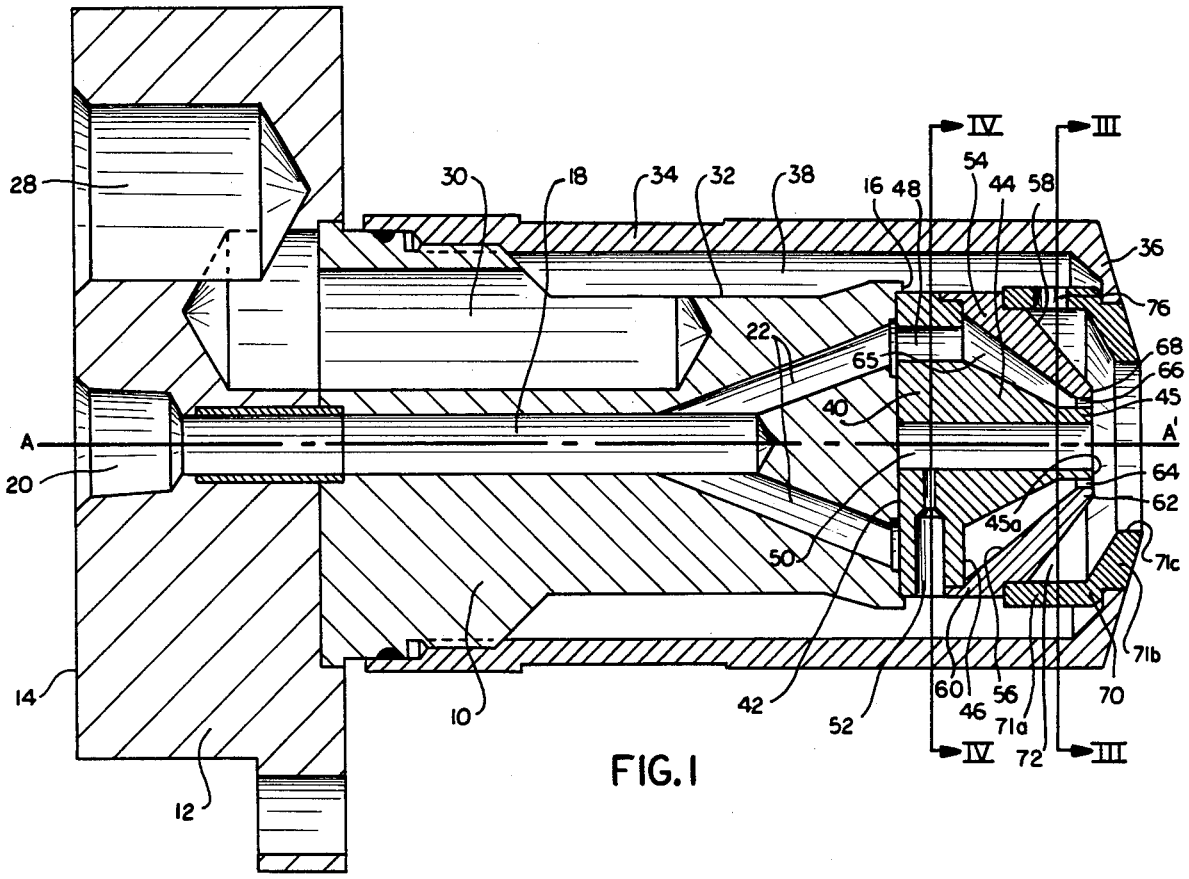
FIG. 1 is an elevational cross-section of a fuel nozzle tip in accordance with the subject invention.
Figure 2:
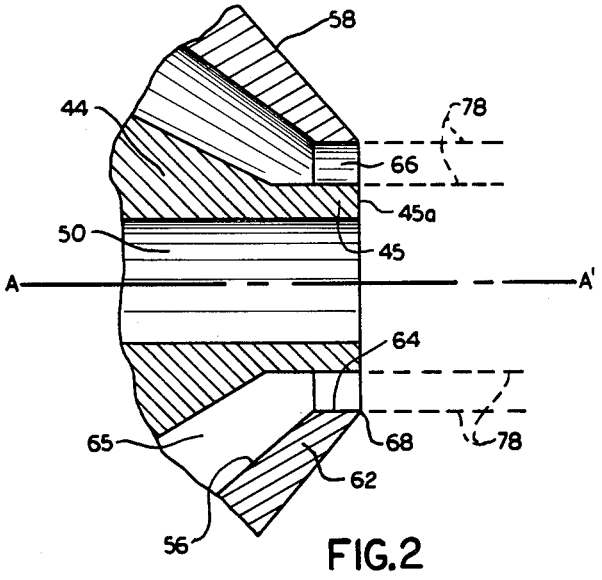
FIG. 2 is an enlarged portion of the cross-section shown in FIG. 1.
Figure 3:
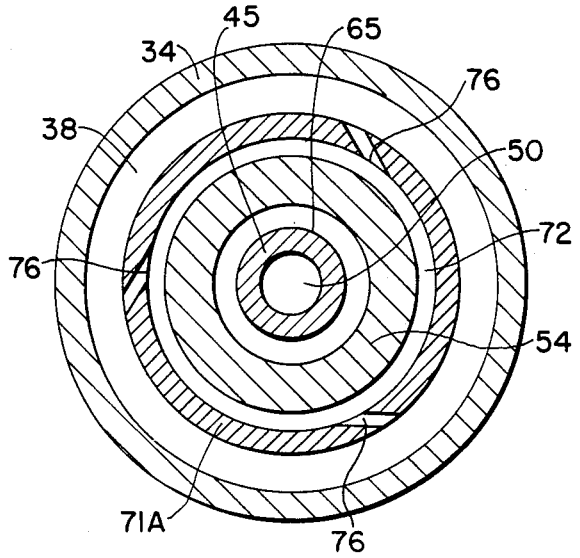
FIG. 3 is a cross sectional view of the subject fuel nozzle tip taken along the lines III—III of FIG. 1.
Figure 4:
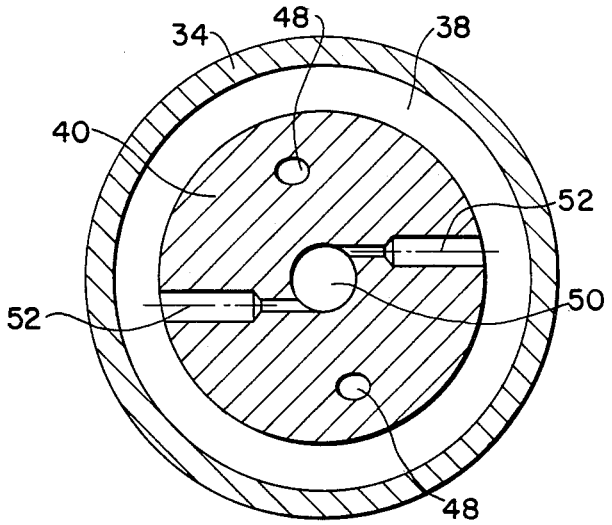
FIG. 4 is a cross sectional view of the subject fuel nozzle tip taken along the lines IV—IV of FIG. 1.

FIGS. 1 and 2 show an atomizer in accordance with the subject invention wherein a body 10 includes a flange portion 12. Body 10 is provided with an input end 14 and a discharge end 16. Body 10 further includes an internal bore 18 that is longitudinally aligned on the axis A–A'. Internal bore 18 opens to a slurry inlet 20 at one end and a plurality of separate passageways 22 at the opposite end. Body 10 also includes an input port 28 and a passageway 30 that forms an opening in the side 32 of body 10.

The subject atomizer further includes a casing 34 that is threadingly engaged with body 10 and covers at least discharge end 16 of body 10. Casing 34 includes a discharge end 36 and cooperates with body 10 to define an annulus 38.

A forming element 40 is located at the discharge end 16 of body 10. Forming element 40 includes an input face 42 at one end and a projection 44 at the other end. Input face 42 contacts discharge end 16 of body 10. Projection 44 generally extends in the direction of the longitudinal axis A–A' and away from discharge end 16 of body 10. Projection 44 includes a tubular member 45 located at the remote end of projection 44. Tubular member 45 includes a discharge end face 45*a*. In the preferred embodiment, forming element 40 further includes a discharge face 46 that is oppositely disposed from input face 42, and a plurality of passageways 48 between input face 42 and discharge face 46. Passageways 48 communicate with passageways 22 in body 10 and, preferably, are aligned therewith by a pin or other locating device.

Forming element 40 further includes an internal bore 50 and a plurality of lateral passageways 52 that open to internal bore 50 and are in fluid communication with annulus 38. Preferably, passageways 52 are aligned tangentially to internal bore 50 such that fluid flowing from annulus 38 to internal bore 50 is caused to swirl in a given sense inside internal bore 50. Also preferably, passageways 48 are aligned on an axis tangential to internal bore 50 such that slurry flowing through the passageways tends to rotate around projection 44.

A conocal section 54 is located adjacent discharge face 46 of forming element 40. Conical section 54 includes an inner conical surface 56, an outer conical surface 58, a base end 60, and an apical end 62. Base end 60 contacts the discharge face 46 of forming element 40. Apical end 62 forms an orifice 64 that is concentric with respect to internal bore 50 of forming element 40. Outer surface 58 forms a rim 68 at orifice 64.

Inner conical surface 56 cooperates with projection 44 and discharge face 46 of forming element 40 to define a conical chamber 65. Conical chamber 65 communicates with separate passageways 22 of body 10 through passageways 48 in forming element 40.

Orifice 64 cooperates with tubular member 45 of forming element 40 to define an annulus 66 therebetween. Preferably, rim 68 of orifice 64 is in substantially the same plane as the discharge end face 45*a* of tubular member 45. Thus, rim 68 is at substantially the same position on longitudinal axis A–A' as end face 45*a*.

A swirler 70 is located between discharge end 36 of casing 34 and base end 60 of conical section 54. Swirler 70 includes an annular ring 71*a* that is integrally connected to a cone-shaped portion 71*b* that defines a discharge orifice 71*c*. The annular ring 71*a* of swirler 70 contacts discharge end 36 of casing 34 and base end 60 of conical section 54. Discharge end 36 of casing 34 cooperates with discharge end 16 of base 10 to maintain swirler 70, conical section 54 and forming element 40 in compression therebetween.

Swirler 70 cooperates with conical section 54 to define a swirl chamber 72 therebetween. Swirler 70 also provides a flow path between annulus 38 and swirl chamber 72. In the preferred embodiment, this flow path is a plurality of lateral bores 76 that are aligned tangentially with respect to conical section 54 and internal bore 50 such that swirled fluid is provided to swirl chamber 72 from annulus 38 through lateral bores 76.

In the preferred embodiment, lateral bores 76 are tangentially aligned to internal bore 50 in an opposite sense from the tangential alignment of lateral passageways 52. Thus, the fluid provided to internal bore 50 is swirled in an opposite sense from the fluid provided to swirl chamber 72. Also in the preferred embodiment, passageways 48 of forming element 40 are tangentially aligned with respect to internal bore 50 to provide swirled flow to conical chamber 65.

In the operation of the preferred embodiment, a fuel slurry, such as a coal/water slurry, is provided to slurry inlet 20 and compressed gas, such as air or steam is provided to input port 28. The fuel slurry flows through central bore 18 to passageways 22. From passageways 22 the slurry flows through passageways 48 into conical chamber 65.

For slurries having viscosities of less than about 200 centipoise, the tangential orientation of passageways 48 causes the slurry to swirl in conical chamber 65. Slurries having increasingly higher viscosities experience progressively less swirling. However, even such high viscosity slurries have sufficient angular motion to provide even filling of conical chamber 65. The slurry progresses through conical chamber 65 toward annulus 66. When it reaches annulus 66, it has been formed into a continuous cylindrical sheet as indicated by broken lines 78 in FIG. 2.

At the same time that the slurry is being formed into a continuous cylindrical sheet, the compressed gas provided to input port 28 passes through passageway 30 into annulus 38. The gas in annulus 38 flows through lateral passageway 52 and is swirled through internal bore 50 in a general direction toward dicharge face 45*a* of tubular member 45. The gas in annulus 38 also passes through lateral bores 76 into swirl chamber 72 and is swirled toward discharge orifice 71*c*.

In the region of swirl chamber 72 adjacent discharge face 45*a*, the swirling gas exiting tubular member 45 and the swirling gas from lateral bores 76 interact with the continuous cylindrical sheet of slurry flowing from annulus 66. This interaction atomizes the slurry film and mixes it thoroughly with the gas. The atomized slurry then exits the nozzle through discharge orifice 64. The swirling gas exiting tubular member 45, in addition to atomizing and mixing the cylindrical slurry film, acts against the inside of the cylindrical slurry film such that it tends to maintain the film from collapsing and tends to retard the formation of slugs in the sheet.

For high viscosity slurries, the angular momentum of the cylindrical film that results from the swirl of the slurry in conical chamber 65 may be very low. Consequently, for these applications, the gas exiting tubular member 45 can be swirled in the opposite sense from the gas in swirl chamber 72 to more fully atomize the slurry film and thoroughly mix the particles with the gas.

In designing the nozzle, the radial dimension of annulus 66 is selected with regard to the maximum particle size for the slurry, the preferred slurry velocity through annulus 66 and the flow rate required for the nozzle. It is preferable to limit the slurry velocity at annulus 66 in order to control erosion of the annular surfaces by the slurry particles. Thus, the preferred embodiment avoids exposure of the nozzle's internal surfaces to high velocity slurry particles. For example, for a slurry having a maximum particle size of 300 micrometers, 900 centipoise viscosity, and a required nozzle flow rate of 500 pounds per hour, the preferred size of annulus 66 is 0.040 inch (1.02 mm) width and 0.250 inch (6.35 mm) outer diameter.

The position of discharge face 45*a* of tubular member 45 in the same plane as rim 68 of conical section 54 is preferred because this arrangement has been found to provide greater atomization and mixing of the cylindrical slurry film.

While a presently preferred embodiment of the invention is shown and described herein, the subject invention is not limited thereto, but can be otherwise variously embodied within the scope of the following claims.

We claim:

1. A slurry atomizer comprising:

a body having an input end and a discharge end, said body including at least one passageway in communication with the input end and forming an opening at the discharge end;

a casing that covers at least the discharge end of said body and cooperates with said body to define a fluid annulus therebetween, said fluid annulus having a fluid inlet;

a forming element located at the discharge end of said body and having an input face at one end and a generally axially extending projection at the opposite end, said forming element also including slurry passgeways that communicate with the passageway of said body, and further including at internal bore and at least one passageway that opens to the internal bore and is in communication with the fluid annulus;

a conical member having an apical end, a base end, an inner conical surface and an outer conical surface, said base end being located adjacent said forming element and said inner conical surface cooperating with the projection of said forming element to define a conically shaped chamber having an annulus between the projection and apical end of said conical member and with the slurry passageways of said forming element opening to the conically shaped chamber; and means for swirling fluid, said swirling means being located between the casing and the base end of said conical member, said swirling means having a discharge orifice and cooperating with the outer conical surface of said conical member to define a swirl chamber therebetween, said swirling means further having a flow path between the fluid annulus and the swirl chamber.

2. The slurry atomizer of claim 1 wherein the projection of said forming element includes a tubular member.

3. The slurry atomizer of claim 1 or 2 wherein said conical member forms an orifice at the apical end, said orifice being concentrically located with respect to the internal bore of the forming element.

4. The slurry atomizer of claim 2 wherein said tubular member has a discharge end face that is substantially at the same longitudinal position in said atomizer as the apical end of the outer conical surface of said conical member.

5. A nozzle for atomizing a fuel slurry, said nozzle comprising:

a body having an input end and a discharge end, said body including a plurality of passageways in communication with the input end, each of said passageways forming an opening at the discharge end of said body;

a casing that covers at least the discharge end of said body to define a fluid annulus therebetween, said fluid annulus having a fluid inlet;

a forming element located at the discharge end of said body, said forming element having an input face and an oppositely disposed discharge face with at least one passageway between the input face and the discharge face, said forming element further including a projection that extends from the discharge face in a generally axial direction from the discharge face, said forming element further having an internal bore and lateral passageways that communicate between the annulus and the internal bore;

a conical section located adjacent the discharge face of said forming element and cooperating with the projection of the forming element to define a conically shaped chamber with an annulus at the apical end; and an air swirler retained between the concial member and the casing, said air swirler having means for swirling air flowing from the annulus to the discharge orifice.

6. The nozzle of claim 5 wherein the discharge face of said forming element cooperates with the conical member and the projection of the forming element to define the conically shaped chamber.

7. The nozzle of claim 5 or 6 wherein the passageway between the input face and the discharge face of said forming element opens to the conically shaped chamber.

8. A nozzle for atomizing a fuel slurry, said nozzle comprising:

a body having an input end and a discharge end, said body including a plurality of passageways in communication with the input and, each of said passageways forming an opening at the discharge end of said body;

a casing that covers at least the discharge end of said body to define a fluid annulus, said fluid annulus having a fluid inlet;

a forming element located at the discharge end of said body, said forming element having an input face and an oppositely disposed discharge face with at least one passageway between the input face and the discharge face, said forming element further having an internal bore and lateral passageways that communicate between the fluid annulus and the internal bore and that are tangentially aligned with respect to the internal bore to provide swirled fluid to the internal bore, said forming element further including a projection that extends from the discharge face in a generally axial direction;

a conical member located adjacent the discharge face of the forming element, said conical having an apical orifice and cooperating with the projection of the forming element to define a conically shaped chamber with an annulus at the apical end of the conical shaped chamber; and means for swirling air, said air swirling means being retained between the conical member and the casing and cooperating with the conical member to define a swirl chamber, said air swirling means having a discharge orifice and a fluid flow path between the annulus and said swirl chamber to provide swirled fluid to the swirl chamber.

9. The nozzle of Claim 8 wherein the fluid flow path of said air swirling means comprises a plurality of bores that are tangentially aligned with respect to the internal bore of said forming element.

10. The nozzle of claim 9 wherein the lateral passageways are tangentially aligned with respect to the internal bore of said forming element and in an opposite sense from the alignment of the bores in the said air swirling means such that the fluid provided to the internal bore is swirled in an opposite sense from the fluid provided to the swirl chamber.

11. The nozzle of claim 9 or 10 wherein the passageways between the input face and the discharge face of the forming element are tangentially aligned with respect to the internal bore to provide swirled flow to the conically shaped chamber.

* * * * *